US006477807B1

(12) United States Patent
Crondahl et al.

(10) Patent No.: US 6,477,807 B1
(45) Date of Patent: Nov. 12, 2002

(54) ARTICULATING DOOR HINGE SYSTEM AND DOOR ASSEMBLY

(75) Inventors: Michael A. Crondahl, North Vancouver (CA); David M. Chard, Lynden, WA (US); James W. Chard, Jr., Vancouver, WA (US); Ryan E. Johnson, Salmon Arm (CA)

(73) Assignee: Westmill Industries Limited, Aldergrove (CA)

( * ) Notice: Subject to any disclaimer, the term of this patent is extended or adjusted under 35 U.S.C. 154(b) by 0 days.

(21) Appl. No.: 09/709,240

(22) Filed: Nov. 7, 2000

(51) Int. Cl.[7] ..... E05F 11/52
(52) U.S. Cl. ..... 49/211; 16/366
(58) Field of Search ..... 49/209, 211, 216, 49/218, 219, 225, 254; 16/233, 357, 360, 361, 366

(56) References Cited

U.S. PATENT DOCUMENTS

| | | | | | |
|---|---|---|---|---|---|
| 1,202,068 | A | | 10/1916 | Juruick | |
| 2,295,324 | A | | 9/1942 | Arthur | |
| 2,337,948 | A | | 12/1943 | Vani | |
| 3,242,536 | A | | 3/1966 | Soddy | |
| 3,683,552 | A | * | 8/1972 | Bollinger | 49/209 |
| 4,020,594 | A | | 5/1977 | Ceyer | |
| 5,087,087 | A | | 2/1992 | Vetter et al. | |
| 5,347,757 | A | * | 9/1994 | Losito | 49/211 |
| 5,901,415 | A | * | 5/1999 | Morrison et al. | 16/366 |
| 5,915,441 | A | * | 6/1999 | Schlack | 16/366 |
| 6,175,991 | B1 | * | 1/2001 | Driesman et al. | 16/366 |

* cited by examiner

*Primary Examiner*—Jerry Redman
(74) *Attorney, Agent, or Firm*—Dellett & Walters; George F. Kondor

(57) ABSTRACT

A door hinge system and door assembly allow a door in a wood veneer dryer to be pulled directly away from its associated door frame before being allowed to swing open in the normal fashion, thus reducing wear on the seal between the door and the door frame. The door assembly allows the tightness of the door to be easily adjusted without the need for shims, and allows the tightness to be adjusted even when the dryer is in operation.

11 Claims, 12 Drawing Sheets

ARTICULATING DOOR HINGE SYSTEM AND DOOR ASSEMBLY

TECHNICAL FIELD

This invention relates to door hardware, and more particularly to hinges which allow a door to articulate outwardly from a door frame before being allowed to swing open.

BACKGROUND

Many large, enclosed industrial structures have access doors along their lengths to allow workers to access the interior of the structure for monitoring, maintenance and repair purposes. One such enclosure which has a plurality of doors is a wood veneer dryer, which dries wood veneers by heat. The doors in a veneer dryer allow access to various portions of the machinery, including rollers, contained within the dryer.

Each of these doors in a veneer dryer requires a seal sandwiched between the door and the door frame, the seal affixed either to the door or to the corresponding door frame. Such a seal prevents air from being drawn into the dryer, thereby reducing the potential for a fire, and also prevents the hot, acrid air produced within the dryer from escaping from the dryer into the surrounding environment. Further, the seals are needed to properly maintain pressure differentials within portions of the dryer itself. It is thus important to maintain these seals in very good condition.

There are two significant problems with these seals in current veneer dryers. First, the doors in most veneer dryers are hinged to the door frames in a standard manner, ie. by simple hinges which allow the doors to swing open in a typical fashion. This swinging action wears the door seals unevenly, and in particular, the portion of the seal closest to the hinged edge of the door wears quickly, as the door is opened and closed, relative to the other portions of the seal. Given the importance of these seals in a veneer dryer, the seals require constant monitoring and frequent replacement, costing the dryer operator money and lost time.

Second, most portions of veneer dryers, which are generally made of metal, naturally expand significantly when hot, and contract when cold. The amount of expansion, of course, depends largely on the temperature reached in the dryer, and the material used in construction of the dryer. The door of a dryer may expand and contract at a different rate than the door frame to which it is attached. This alters the pressure on the seal sandwiched between the door and the door frame.

An operator may try to compensate for this by trying to adjust the force exerted by the door against the door frame (ie. the door's tightness) to try to maintain a constant pressure on the seal between them. Currently, operators try to accomplish this by adding or removing shims between the hinges and the door and/or door frame. This is an inaccurate, time consuming procedure which cannot be done when the dryer is in operation.

To limit the aforementioned uneven and premature wear on the door seals, therefore, it would be useful to provide an improved door hinge system which allows an operator to first move a veneer dryer door relatively straight out and away from the door frame before swinging the door open in a typical fashion. This would allow the door seal to wear relatively evenly, reducing the need for frequent replacement.

Further, to make it possible to adjust the force exerted by the door against the door frame (ie. to adjust the pressure on the seal), it would be helpful to provide associated means for allowing a door to be tightened or loosened against its frame while it is in a closed position.

SUMMARY OF THE INVENTION

The present invention provides a door hinge system for attaching a door to a door frame. Most broadly, the invention comprises, in combination, a linkage having a first end pivotally connected to a door at a first pivot axis and a second end pivotally connected to the door frame at a second pivot axis; and an arm pivotally connected at a first end to the linkage at a third pivot axis further from the door than the plane between said first and second axes. In this manner, the door can be moved outwardly relative to the door frame by moving the rod longitudinally towards said linkage, and then swung open in a normal fashion.

While the linkage can be connected directly to the door, in a retrofittable version of the invention, the first pivot axis passes through a first hinge portion attached to the door and the second pivot axis passes through a second hinge portion attached to the door frame. The linkage is accordingly connected to both of said hinge portions.

The arm itself may have a u-shaped bracket pivotally connected to the linkage and a threaded arm portion threaded into a block provided in the u-shaped bracket for receiving the threaded arm portion. A locking nut threaded against the block may secure the threaded arm portion to the u-shaped bracket. When the arm is fixed at its second end, shortening it by threading the threaded arm portion further into the block pulls against the linkage, tightening the door against the door frame.

In a further embodiment of the invention, a latch assembly is provided to the door which, in combination with the aforementioned hinge system, makes up a door assembly for tightening the door against the door frame in this assembly, the arm traverses the door and is connected at its second end to the latch assembly. The latch assembly has includes means for moving the arm from a first position pulling on the linkage to close the door to a second position pushing on the linkage to open the door. The arm can be shortened to tighten the door against the door frame (more particularly, against the seal sandwiched between the door and door frame), when the door is in a closed position. This can be accomplished by providing the arm with oppositely-threaded end portions and a central portion threaded onto each. Turning the central portion draws together, or forces apart, the ends of the arm.

BRIEF DESCRIPTION OF DRAWINGS

In drawings which illustrate specific embodiments of the invention, but which should not be construed as restricting the spirit or scope of the invention in any way.

DESCRIPTION

Figure 1:
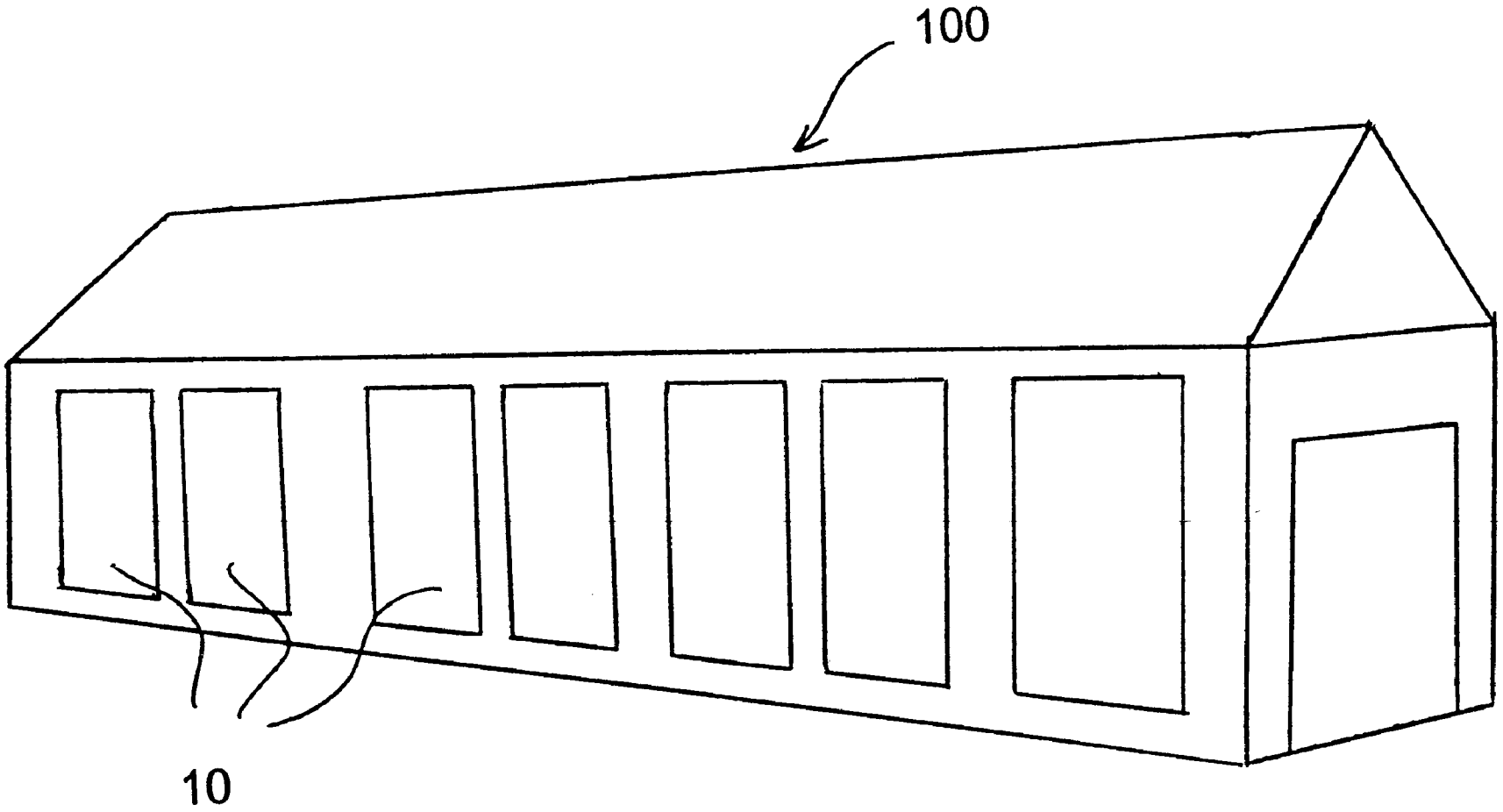
FIG. 1 is a schematic illustration of a veneer dryer, showing a plurality of access doors along one side thereof.

The present invention relates primarily to doors used in a wood veneer dryer of the type shown in FIG. 1, although the invention has application in any situation where a good seal must be maintained between a door and a door frame industrial freezer doors and smoke ovens are other examples where the invention might be used. Reference is made hereafter to a veneer dryer only for the sake of example.

In a veneer dryer, denoted generally hereafter by the numeral "100", a plurality of doors 10 is provided along the length thereof to allow workers to inspect and repair machinery (not shown) contained within dryer 100.

Figure 2A:
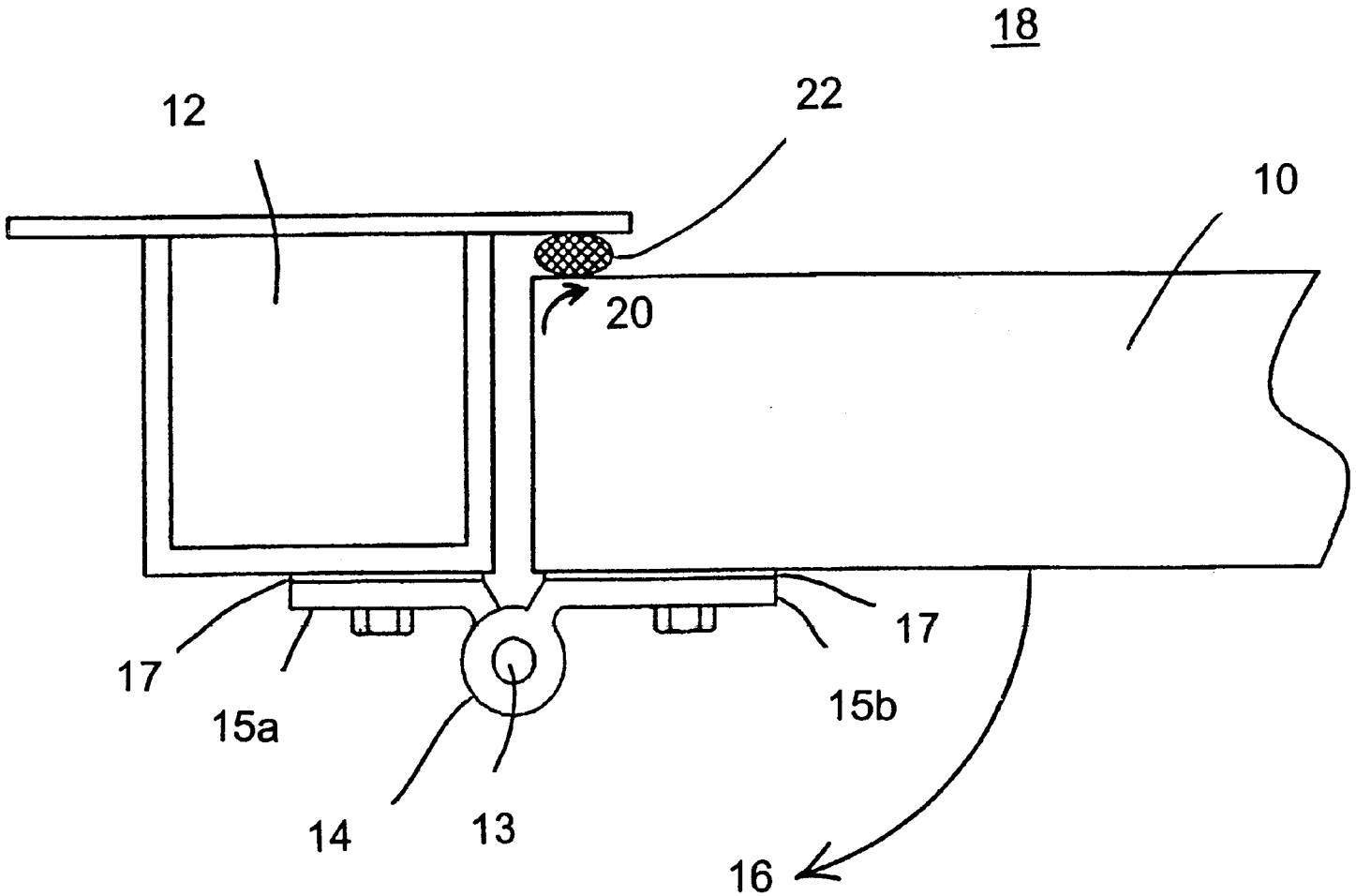
FIG. 2A (PRIOR ART)
FIG. 2A is a cross-sectional illustration of a typical prior art door/door frame arrangement in a veneer dryer, showing a door hinged to a door frame in the typical manner.

In a typical dryer 100, doors 10 are simply hinged in the normal manner to door frames formed within the walls of driver 100. As shown in FIG. 2A, which illustrates a portion of a prior art door/door frame arrangement in cross section, door 10 is typically hinged to door frame 12 by a standard hinge 14 having two hinge leaves 15*a*, 15*b* connected by a hinge pin 13. A seal 22 typically surrounds the door opening. As mentioned earlier, shims 17 may be placed between hinge 14 and door 10 or door frame 12 to adjust the "tightness" of door 10 against door frame 12.

With this arrangement, door 10 opens in the direction of arrow 16, allowing access into the interior 18 of dryer 100. It will be seen from FIG. 2A that this opening movement causes the backside of door 10 to move in the direction indicated by arrow 20. Which tends to pinch or crush a portion of seal 22 sandwiched between door 10 and door frame 12. As described earlier, repeated opening of door 10 tends to prematurely wear the portion of seal 22 which is so crushed.

Figure 2B:
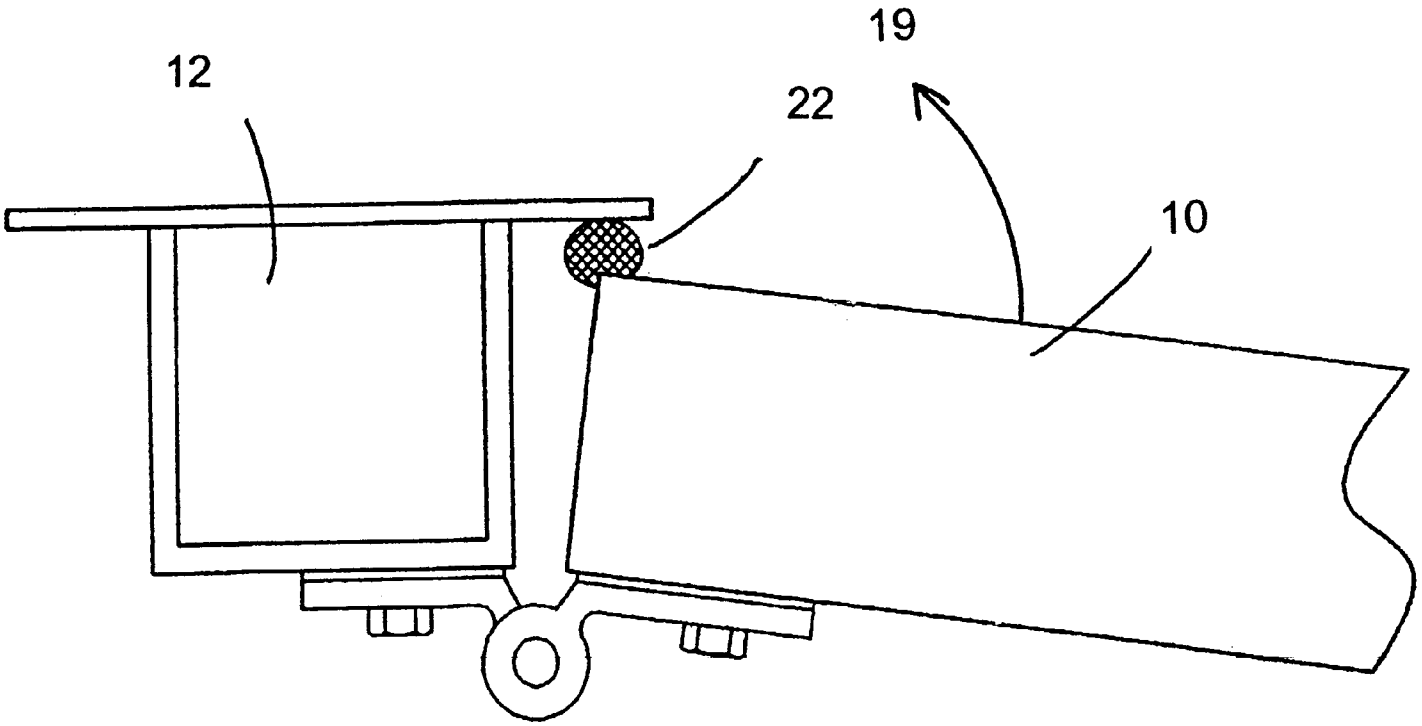
FIG. 2B (PRIOR ART)
FIG. 2B is an illustration of the door/door frame arrangement shown in FIG. 2, showing the seal caught on the door as the door is being closed.

Further, in such prior art system, once door 10 has been opened, seal 22 typically expands, as shown in FIG. 2B. When door 10 is closed again (in the direction of arrow 19), the backside edge of door 10 tends to "catch" seal 22, which is not desirable.

Figure 3A:
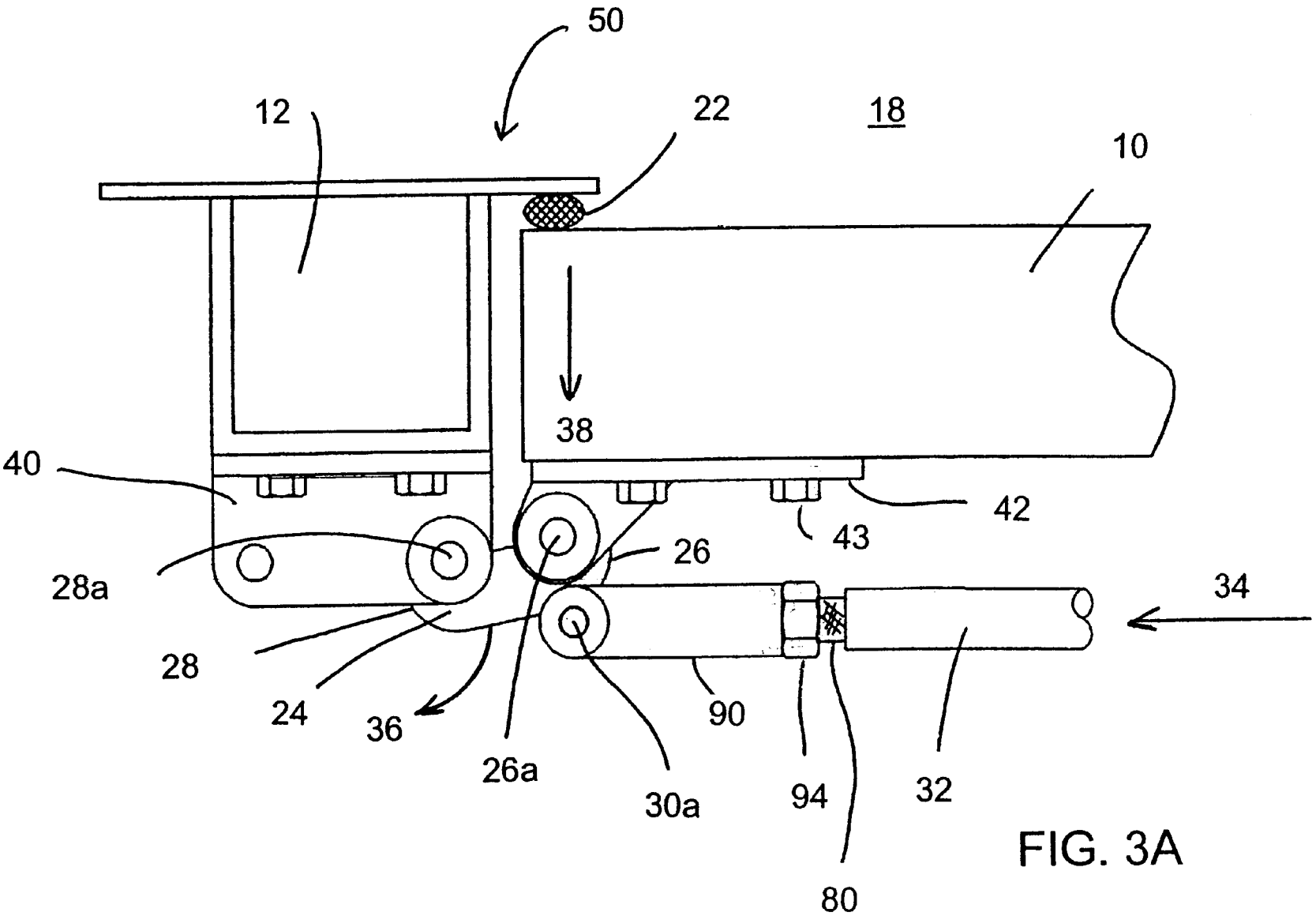
FIG. 3A is a cross-sectional illustration of a door/door frame arrangement made in accordance with the preferred embodiment of the articulating door hinge system of the present invention, with the door in a closed position.

FIG. 3A shows a similar view to FIG. 2, but shows the door hinge system of the present invention, denoted generally hereafter by the numeral "50".

The system 50 of the present invention also has, in a preferred embodiment, a door 10 and a door frame 12 enclosing, together with the other outer portions of dryer 100, the interior 18 of dryer 100. Again, a seal 22 is sandwiched between door 10 and door frame 12 to prevent gases from entering, or escaping from, dryer 100.

System 50 also further has a hinge connecting door 100 to door frame 12. As shown in FIGS. 3A–5, however, in the present system door 10 is attached to door frame 12 by a linkage 24. Specifically, linkage 24 has a first end 26 pivotally connected to door 10 at a first pivot axis 26*a* and a second end 28 pivotally connected to door frame 12 at a second pivot axis 28*a*, conveniently with pins 29 (FIG. 4), as shown. Pins 29 can be held in place in any convenient manner. In this arrangement, door 10 can pivot about axis 26*a*, relative to linkage 24, and the door/linkage combination can pivot about axis 28*a*, relative to door frame 12.

Apart from ends 26, 28, linkage 24 also has a third portion 30 (FIG. 4) serving as a third pivot axis 30*a* to which is further pivotally connected one end of an arm 32, also with a pin 29. As shown in detail in FIG. 4, in one embodiment of the invention, arm 32 has a u-shaped bracket 90 on its end, the middle portion of bracket 90 having a block 92 machined to accept the threaded end 80 of a rod. The significance of this arrangement is described in greater detail below.

Figure 3B:
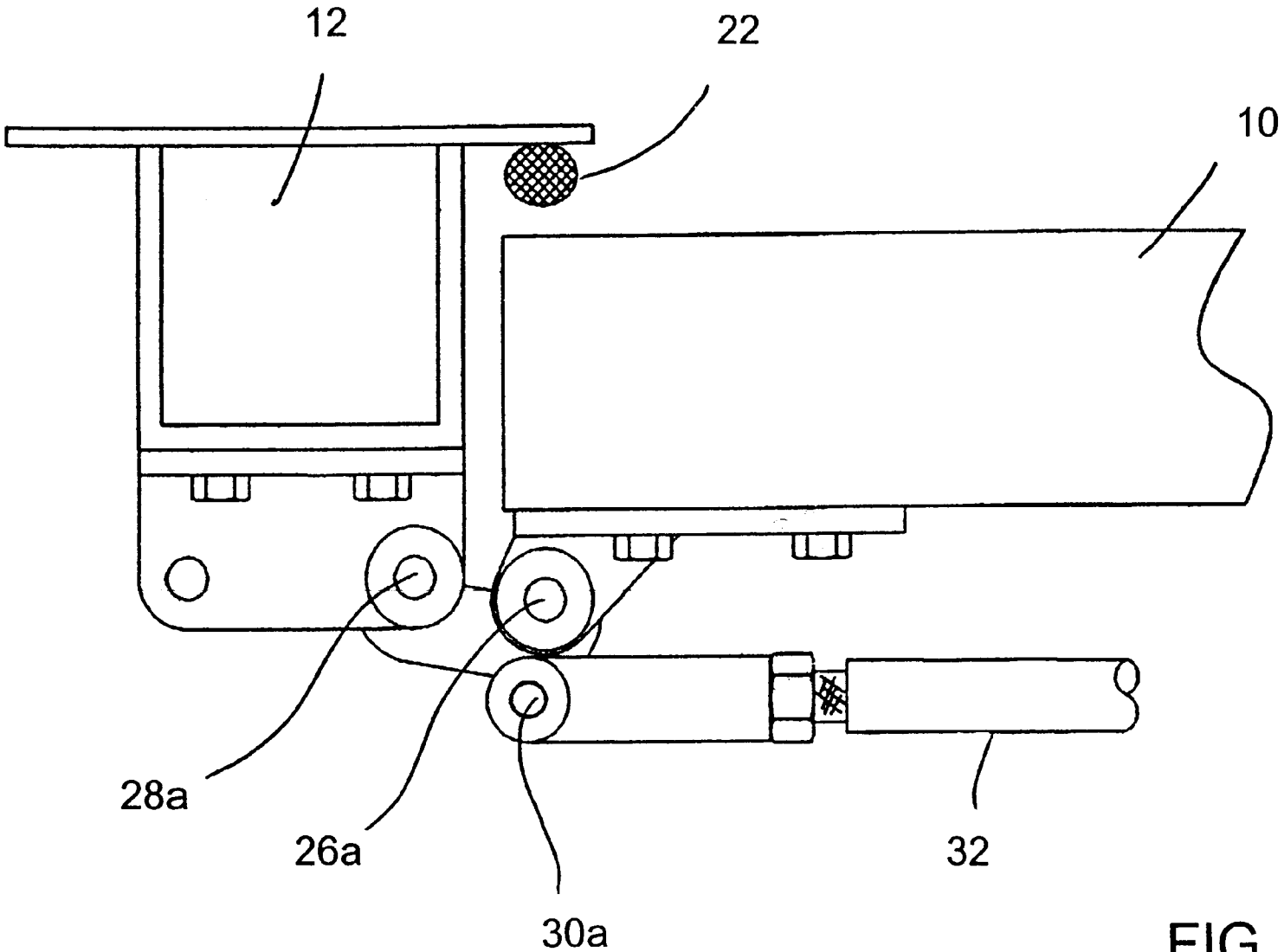
FIG. 3B is an illustration of the door/door frame arrangement shown in FIG. 3A with the door in a first position opened away from the door frame.
Figure 3C:
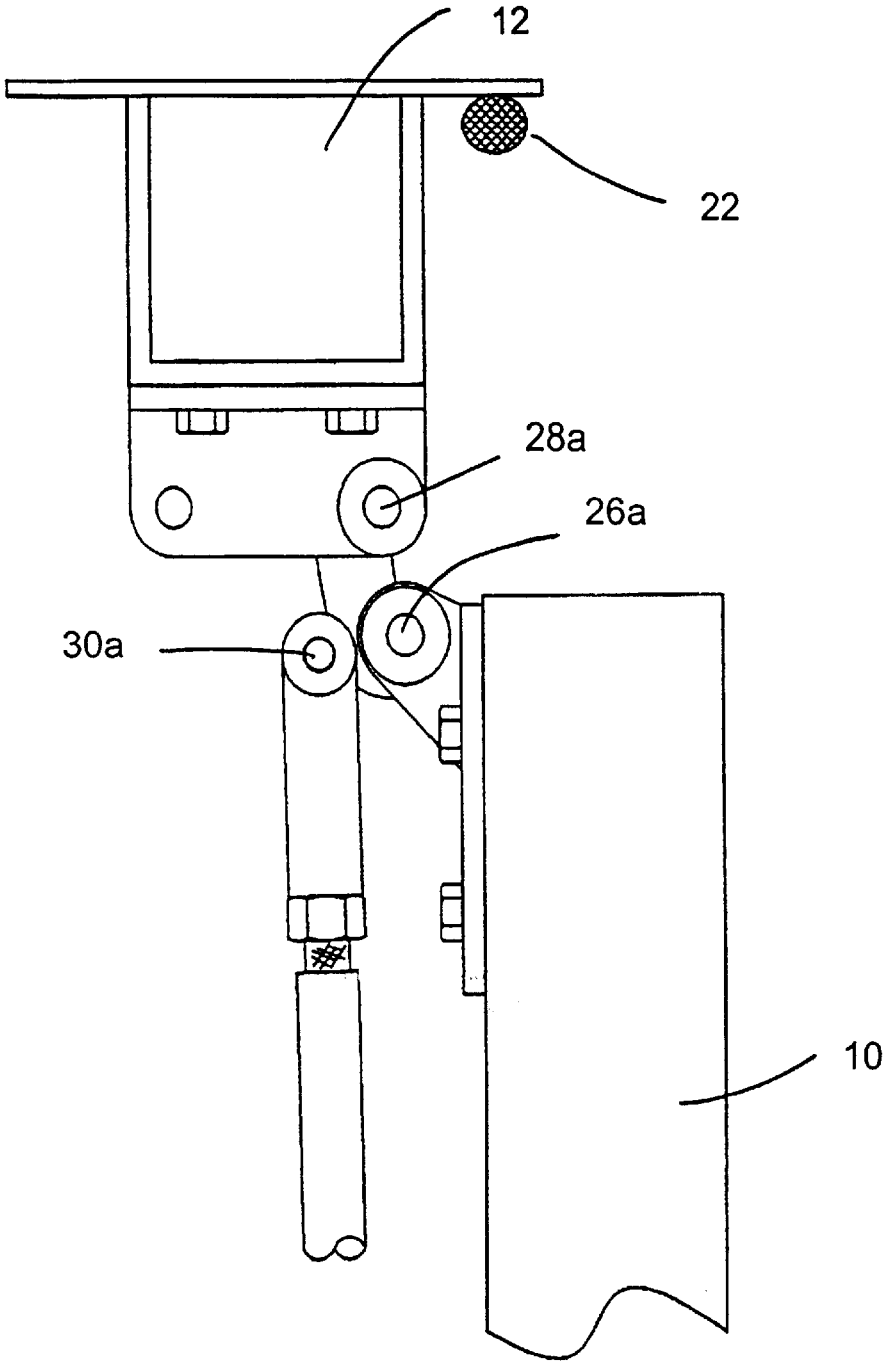
FIG. 3C is an illustration of the door/door frame arrangement shown in FIG. 3A, with the door in a second, fully opened position.
Figure 4:
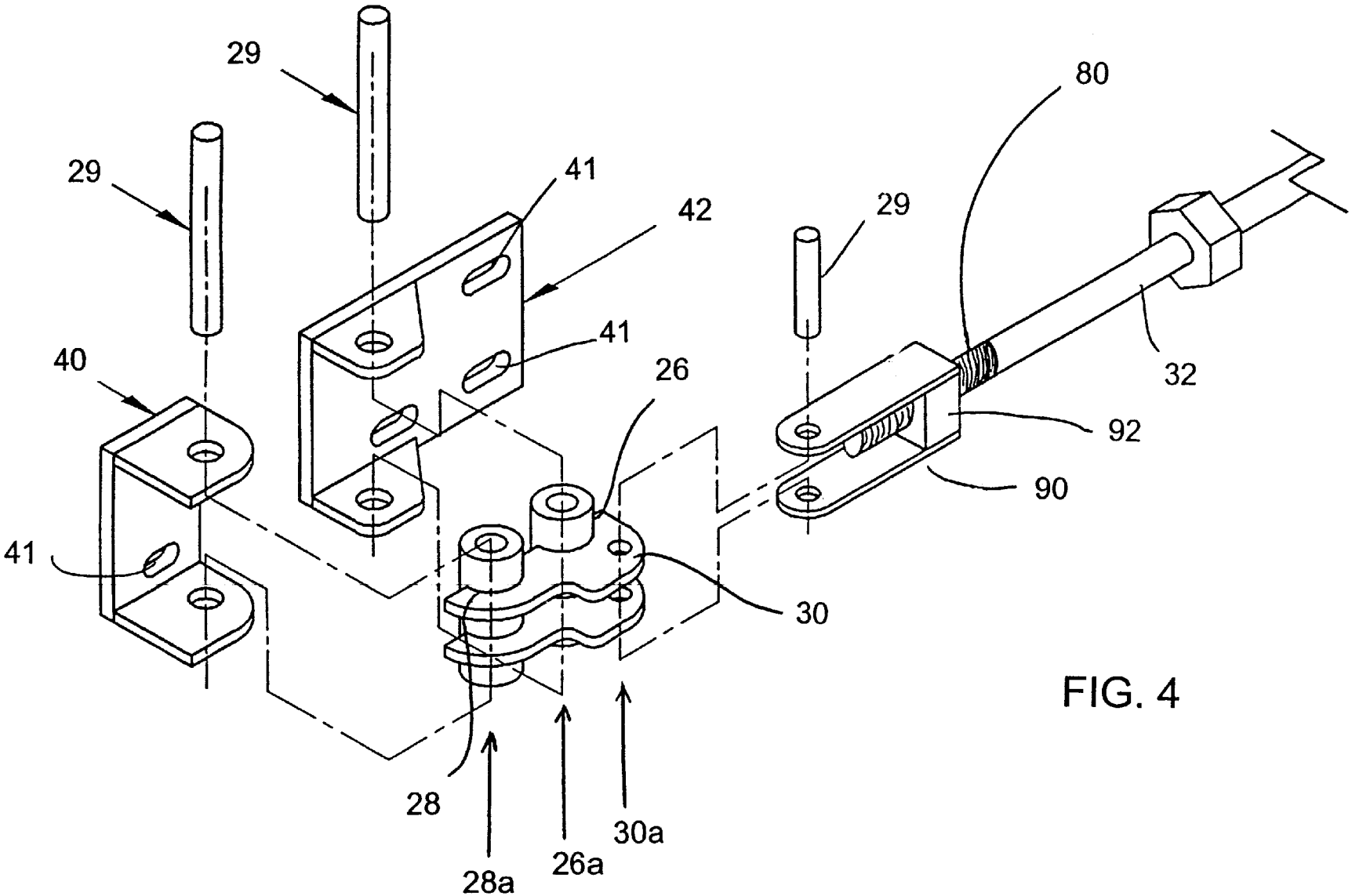
FIG. 4 is a broken view of the components of the door hinge system shown in FIG. 3A.
Figure 5:
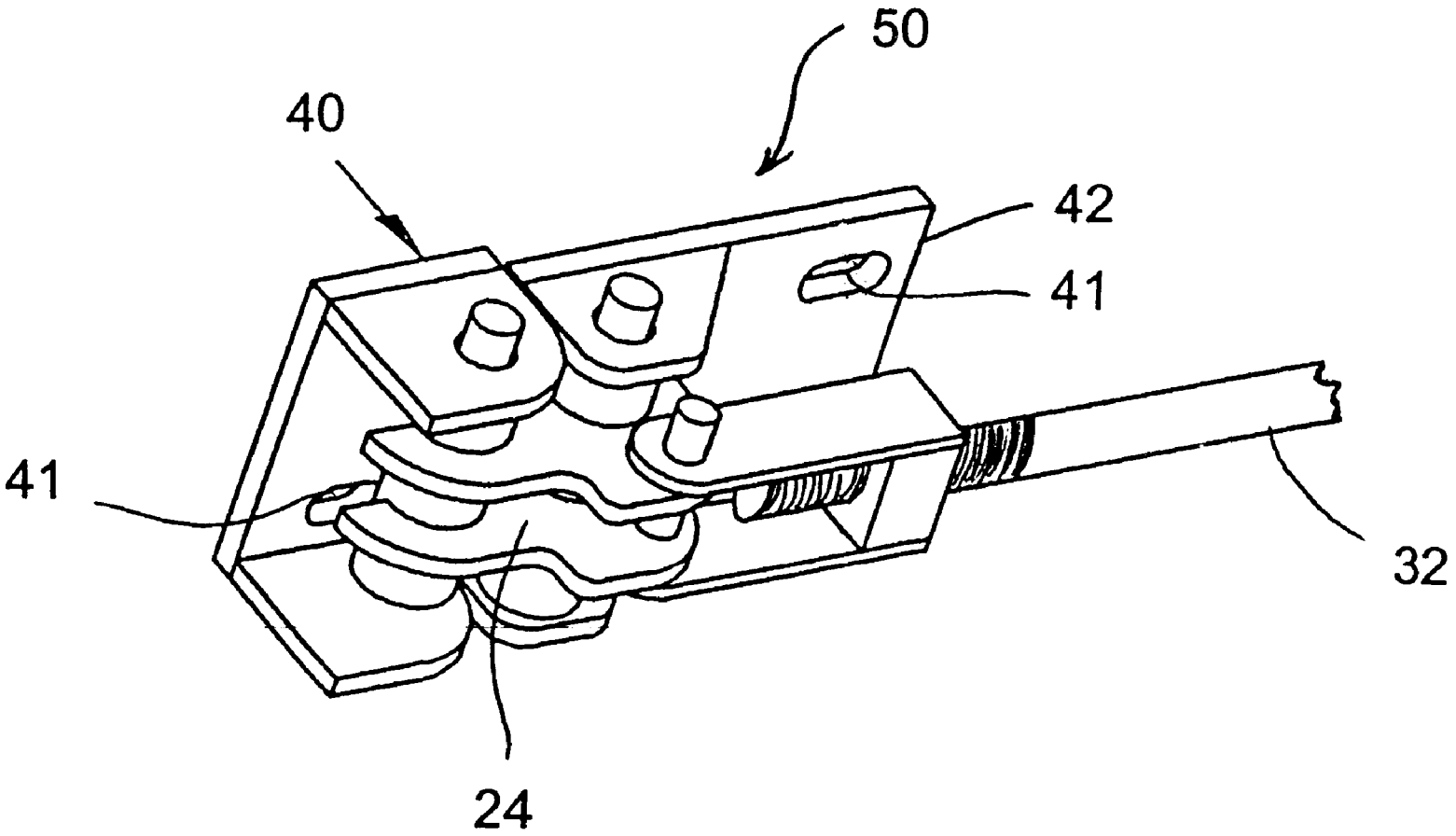
FIG. 5 is a perspective view of the assembled door hinge system shown in FIGS. 3A and 4.

It will be appreciated, as shown in FIGS. 3A–3C, that when pivot axis 30*a* occupies a space further outward of the door than the plane occupied by both the first and second axes, 26*a*, 28*a*, moving arm 32 along its longitudinal axis in the direction of arrow 34 (shown in FIG. 3A) pushes against linkage 24 at axis 30*a*. With enough force, this causes the door/linkage combination pivoted to door frame 12 at pivot axis 28*a* to pivot about that axis in the direction of arrow 36 (clockwise, in the illustration of FIG. 3A).

This action draws door 10 relatively straight out and away from door frame 12 (ie. in the direction of arrow 38), so that its face is roughly parallel, but away from, the wall of dryer 100, as shown in FIG. 3B. It will be appreciated that door 10 pivots slightly counter-clockwise about pivot axis 26*a* when this occurs. It will also be recognized that this action, as opposed to the swinging action of the typical door shown in FIG. 2, avoids the crushing of seal 22 by door 10.

After door 10 has been moved out and away from door frame 12 as described (by a distance dependent upon the relative size of the door, but in a veneer dryer by about 1 inch), door 10 may then be swung open in a traditional manner about axis 28*a*, as shown in FIG. 3C, allowing access to the interior of dryer 100.

Door 10 may be closed in an opposite manner. Namely, when door 10 is open, it may be swung closed in a normal manner until its face is roughly parallel with the wall of dryer 100 (FIG. 3B). Door 10 is then pushed straight back towards door frame 12. Pulling on arm 32 opposite to the direction shown by arrow 34 (FIG. 3A) causes door 10 to be cinched tightly against door frame 12.

In the embodiment shown in FIGS. 3A–5, separate hinge portions 40, 42, each having bolt holes 41, are provided for system 50 to allow the system to be retrofitted onto an existing door by bolts 43. There is no reason, however, that linkage 24 could not be connected directly between flanges formed integrally on both door 10 and door frame 12.

Further, while the previous discussion describes axes 26*a* and 28*a* as occupying the "ends" of linkage 24, this is only for the ease of discussion; the invention encompasses linkages having any two such axes in combination with a third, whether or not they are at the ends of the linkages.

Figure 6:
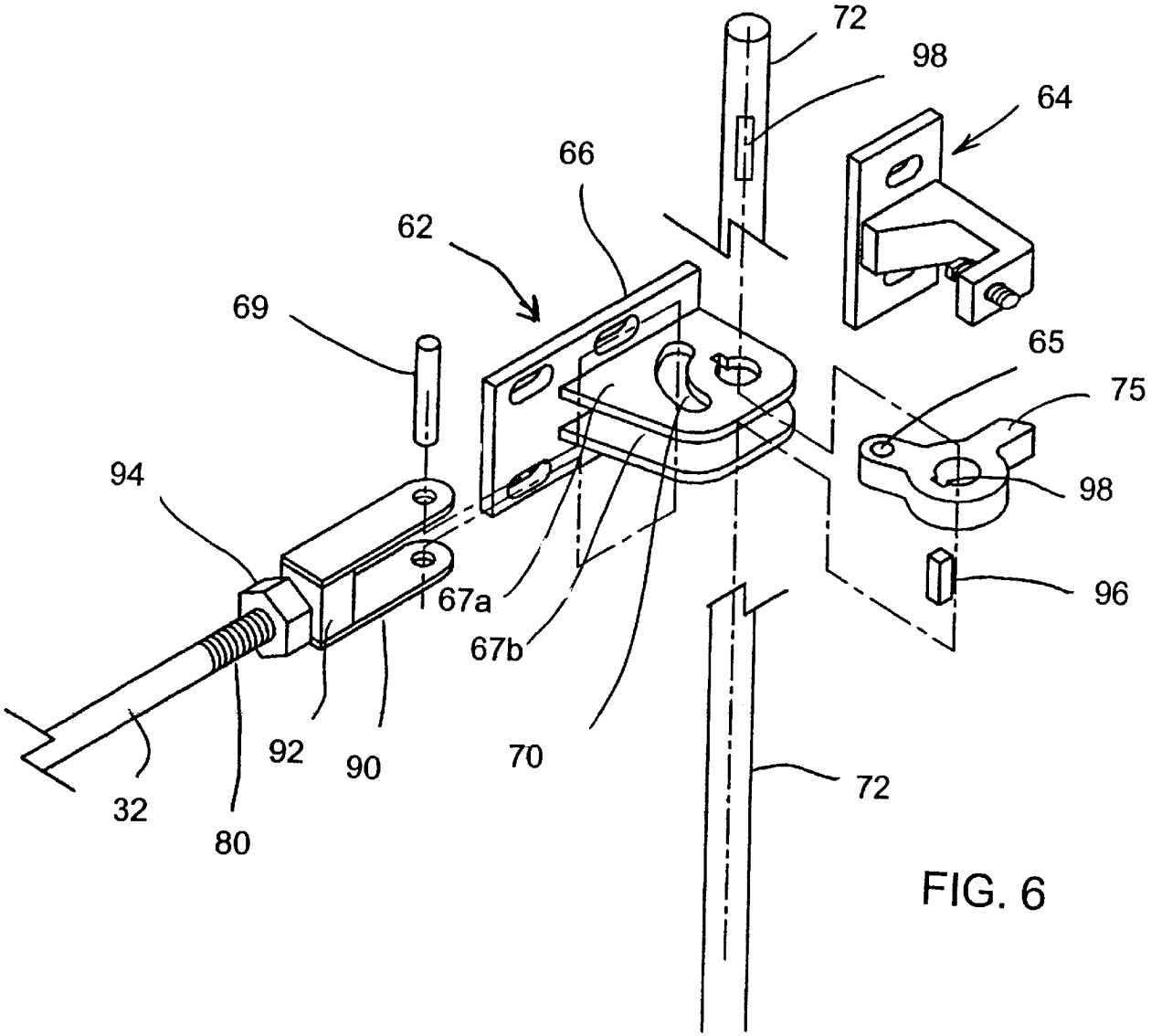
FIG. 6 is a broken view of the latch assembly of the door assembly of the present invention.

In a further embodiment of the invention, a door assembly is provided wherein the arm 32 of the hinge system 50 described above is attached at its opposite end to a latch assembly 60 which allows door 10 to be latched Into a closed position. This door assembly is shown in FIG. 8. While a variety of latch assemblies might be contemplated, in one embodiment of the invention the latch assembly 60, as shown in detail in FIGS. 6 and 7, comprises a door portion 62 attached to door 10 and a door frame portion 64 attached to door frame 12.

In this particular embodiment of the invention, door portion 62 comprises a mounting plate 66 (FIG. 6) having a pair of flanges 67*a*, 67*b*, extending outwardly therefrom. Arm 32 is connected to door portion 62 of latch assembly 60 with a pin 69 passing through arm 32 and through flanges 67*a* and 67*b*. Pin 69 also passes through a hole 65 bored through an arm of an eccentric cam 68 positioned between flanges 67*a* and 67*b*. Again, as described earlier, arm 32 conveniently has a u-shaped bracket 90 on its end, the middle portion of bracket 90 having a block 92 machined to accept a threaded end 80 of a rod. Arm 32 may also have a locking nut 94 which may be threadably abutted against block 92 to secure the end of arm 32 to u-shaped bracket 90.

Figure 7:
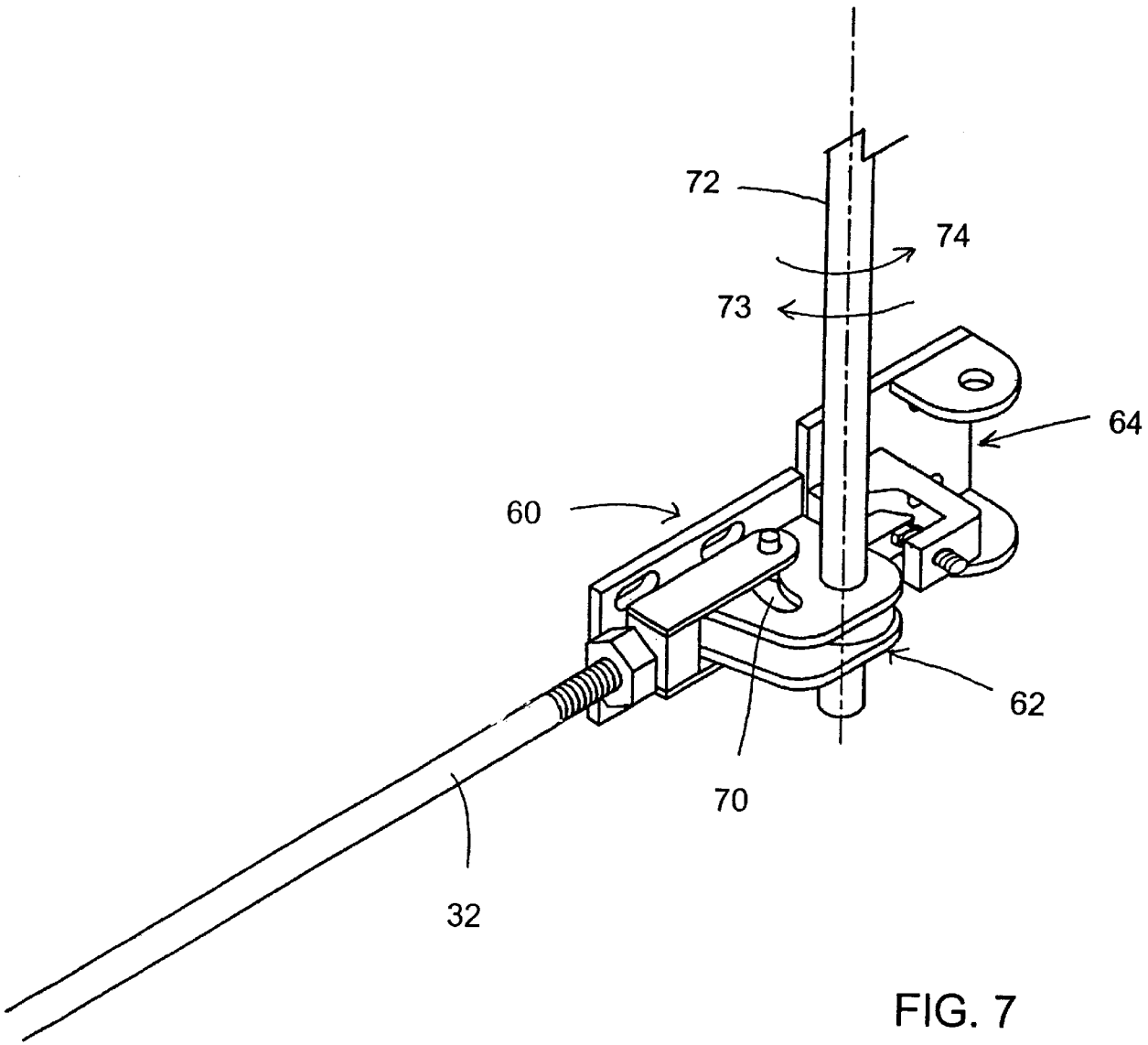
FIG. 7 is a perspective view of the portion of the door assembly shown in FIG. 6.
Figure 8:
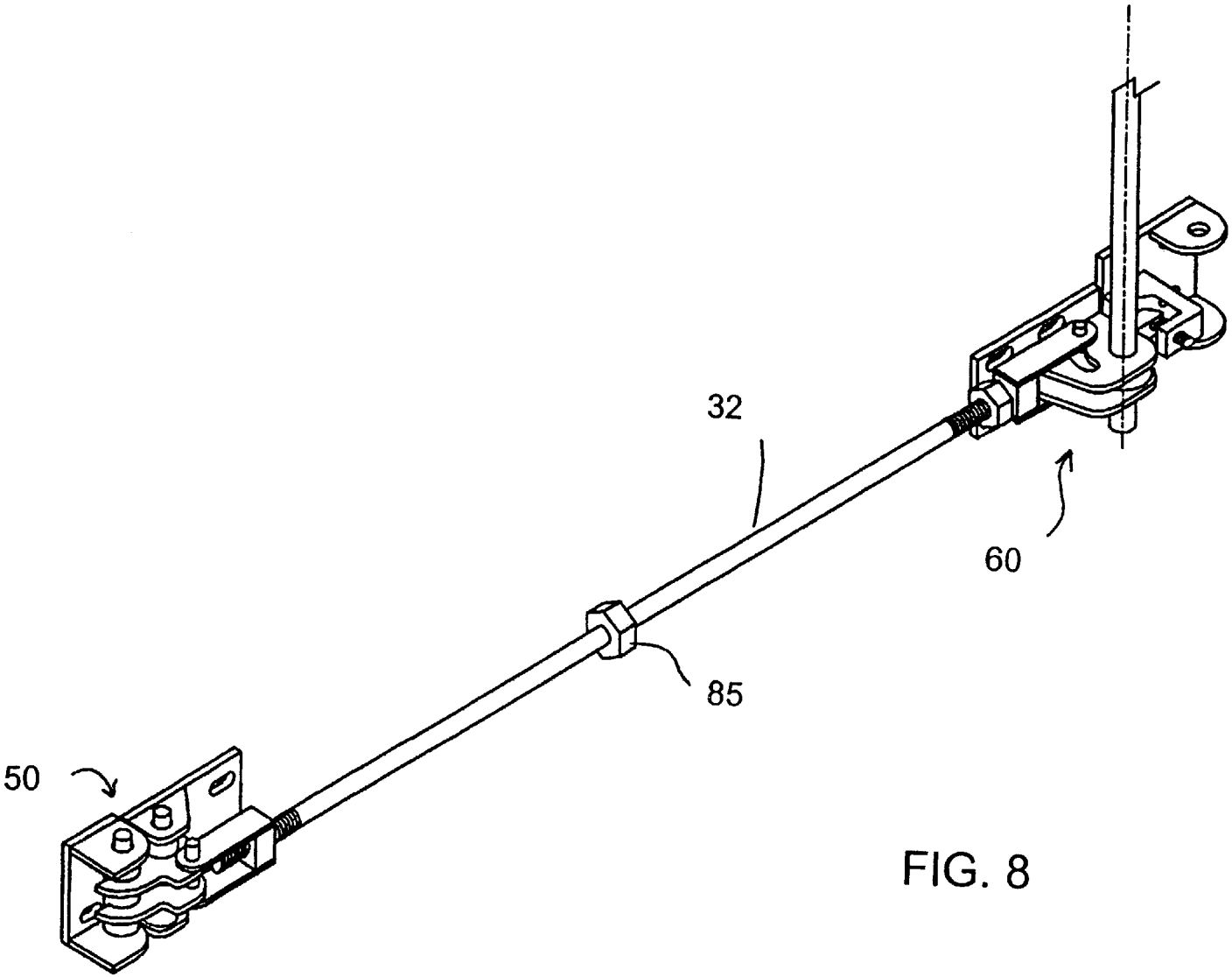
FIG. 8 is a perspective view of the door assembly of the present invention.

Each of flanges 67*a*, 67*b* has a curved channel 70 formed therethrough, allowing arm 32 leeway for movement between a first position (as shown in FIG. 7) wherein arm 32 is drawn close to door frame portion 64 along channel 70, and a second position wherein arm 32 is pushed away from frame portion 64 at the opposite end of channel 70. Pin 69 and arm 32 are forced to follow cam 68 as cam 68 is turned.

Cam 68 may be turned by any suitable means. A vertical bar 72 passing fixedly through cam 68 serves to form such turning means in one embodiment of the invention, although other turning means are contemplated. Bar 72 can be turned by hand, or can itself be attached to a handle or a more complicated arrangement to allow an operator to turn bar 72.

Bar 72 may be fixed to cam 68 by any suitable means, but in the embodiment shown herein is attached by a key stock 96 (FIG. 6) which occupies a key channel 98 formed within both bar 72 and cam 68. Adhesive could also be used.

It will thus be appreciated that when bar 72 is turned in the direction shown by arrow 73 in FIG. 7, this forces cam 68, and accordingly, pin 69 and arm 32 into the first, "closed" position, described above. In this position, arm 32 pulls door 10 tight against door frame 12. When arm 32 is pushed into an "open" position, however, by turning bar 72 in the direction shown by arrow 74 in FIG. 7, cam 68 forces pin 69 and arm 32 along channel 70 away from door frame portion 64 of latch assembly 60, and arm 32 is forced towards hinge system 50. As described in detail earlier, this moves door 10 away from door frame 12. In this manner, door 10 can be opened and closed by turning bar 72.

Door 10 can be latched to door frame 12 by adding a tab 75 to cam 68 which catches door frame portion 64 of latch assembly 60 when cam 68 is in the first, "closed" position, with arm 32 pulled towards door frame portion 64.

Figure 9:
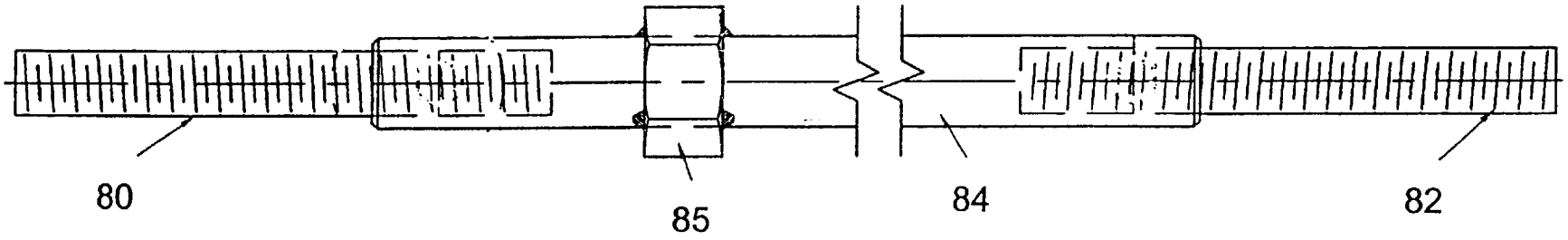
FIG. 9 is a schematic view of a portion of the cross arm of the door assembly shown in FIG. 8.

Another aspect of the invention which is of interest is that the length of arm 32 may be made adjustable. FIG. 9 shows a version of arm 32 having two oppositely-threaded end portions 80, 82, and a central portion 84 threaded onto each of them. Arm 32 may be lengthened or shortened by turning central portion 84. A hexagonal nut 85, shown in detail in FIG. 9, may be tack welded onto central portion 84 of arm 32, and may conveniently assist in turning central portion 84 with a wrench.

The main significance of the ability to lengthen and shorten arm 32 lies in the fact that the ends of arm 32 are also threadably attached to hinge system 50 and lock assembly 60. When fixed at these points by locking nuts 94, shortening arm. 32 by turning central portion 84 causes linkage 24 to be pulled upon by arm 32. Lengthening arm 32 in the opposite manner causes linkage 24 to be pushed upon by arm 32. When door 10 is closed, shortening arm 32 will cinch door 10 closer into door frame 12, since arm 32 will then pull more tightly on linkage 24. If door 10 is too tightly pulled against door frame 12 when closed, it can be loosened by lengthening arm 32. In this manner, the tightness of door 10 against door frame 12, and hence the pressure on seal 22, can be adjusted, even when dryer 100 is in operation.

As will be apparent to those skilled in the art in the light of the foregoing disclosure, many alterations and modifications are possible in the practice of this invention without departing from the spirit or scope thereof. For example, most doors will typically have more than one hinge. In one embodiment of the present invention, the door assembly provides two or more hinges systems, and associated latch assemblies. Bar 72 may be used to connect all latch assembles.

Accordingly, the scope of the invention is to be construed in accordance with the substance defined by the following claims.

What is claimed is:

1. A door hinge system for attaching a door to a door frame, comprising in combination:

a) a linkage having a first end pivotally connected to said door at a first pivot axis and a second end pivotally connected to said door frame at a second pivot axis;

b) an arm pivotally connected at a first end to said linkage at a third pivot axis further from the door than the plane between said first and second axes;

wherein the door can be moved outwardly relative to the door frame by moving said arm longitudinally towards said linkage, and then swung open.

2. The door hinge system as claimed in claim 1 wherein said first pivot axis passes through a first hinge portion attached to said door and said second pivot axis passes through a second hinge portion attached to said door frame, said linkage connected to both of said hinge portions.

3. The door hinge system as claimed in claim 2, wherein said arm further comprises a u-shaped bracket pivotally connected to said linkage, and a threaded arm portion threaded into a block provided in said u-shaped bracket for receiving said threaded arm portion.

4. The door hinge system as claimed in claim 3, further comprising a locking nut threaded against said block, thereby securing said threaded arm portion to said u-shaped bracket.

5. The door hinge system as claimed in claim 4 wherein said arm is fixed at its second end, whereby shortening said arm by threading said threaded arm portion further into said block pulls against said linkage, tightening said door against said door frame.

6. The door hinge system as claimed in claim 5 wherein said linkage is pivotally connected to said hinge portions and to said arm by pivot pins.

7. A door assembly for attaching a door to a door frame, comprising in combination:

a) the hinge system claimed in claim 1, attached to one side of said door and door frame; and b) a latch assembly attached to the opposite side of said door and door frame for latching said door into a closed position;

wherein said arm traverses said door and is connected at its second end to said latch assembly, and wherein said latch assembly includes means for moving said arm from a first position pulling on said linkage to close said door to a second position pushing on said linkage to open said door.

8. A door assembly as claimed in claim 7, wherein said arm comprises:

a) a first threaded portion connected to said hinge system;

b) a second threaded portion connected to said latch assembly, said first and second threaded portions being oppositely-threaded; and c) a central portion threadably connected between said first and second threaded portions, whereby the length of said arm may be adjusted by turning said central portion.

9. A door assembly as claimed in claim 8, wherein said latch assembly further comprises a) a door portion attached to said door, said door portion comprising a mounting plate having a pair of flanges extending outwards therefrom; and b) a door frame portion attached to said door frame, said arm connected to said door portion with a pin passing through said arm and through said flanges.

10. A door assembly as claimed in claim 9 further comprising:

a) an eccentric cam positioned between said flanges, said pin also passing through said cam; and b) a curved channel formed through said flanges, wherein said arm may move between a first position close to said door frame portion when said pin is at one end of said channel, and a second position wherein said arm is pushed away from said door frame portion at the opposite end of said channel.

11. A door assembly as claimed in claim 10 wherein said cam is turned by a bar passing therethrough.

* * * * *